United States Patent [19]

Noh

[11] Patent Number: 5,050,368

[45] Date of Patent: Sep. 24, 1991

[54] SHRINK PACKAGING APPARATUS

[75] Inventor: Chuji Noh, Sakai, Japan

[73] Assignee: Tokiwa Kogyo Co., Ltd., Osaka, Japan

[21] Appl. No.: 463,431

[22] Filed: Jan. 11, 1990

[51] Int. Cl.[5] ..... B65B 53/06

[52] U.S. Cl. ..... 53/442; 53/450; 53/550; 53/557; 34/218

[58] Field of Search ..... 34/210, 218; 219/388; 53/442, 550, 557, 580

[56] References Cited

U.S. PATENT DOCUMENTS

| | | | |
|---|---|---|---|
| 3,099,115 | 7/1963 | McKibben et al. | 53/557 X |
| 3,115,735 | 12/1963 | Harrison | 53/557 |
| 3,362,128 | 1/1968 | James | 53/442 X |
| 3,381,443 | 5/1968 | Copping | 53/557 X |
| 3,545,165 | 12/1970 | Greenwell | 53/442 X |
| 3,616,546 | 11/1971 | Billingsley et al. | 53/557 X |
| 3,782,070 | 1/1974 | Erlandson | 53/557 |
| 4,430,844 | 2/1984 | James . | |
| 4,715,166 | 12/1987 | Kameda . | |

FOREIGN PATENT DOCUMENTS

| | | | |
|---|---|---|---|
| 2016039 | 10/1971 | Fed. Rep. of Germany | 53/557 |
| 56-12533 | 3/1981 | Japan . | |

*Primary Examiner*—John Sipos

[57] ABSTRACT

A shrink packaging apparatus wherein articles surrounded by a heat shrinkable film are transported on a double side-holding conveyor and a carry-on conveyor for being sequentially fed into a series of heating units so that each article is uniformly heated all over in order to allow the entire film to come in contact with the entire surface of the article in a sightly manner, whereby shrink-wrapped packages having a good appearance can be produced.

20 Claims, 9 Drawing Sheets

SHRINK PACKAGING APPARATUS

BACKGROUND OF THE INVENTION

1. Field of the Invention

This invention relates to a shrink packaging apparatus for use in packaging dry cells and other articles with a film held in contact with their outer surface.

2. Description of the Prior Art

Shrink packaging techniques have been known including, as a typical example, the one described in Japanese Patent Publication No. 56-12533 (Published: Mar. 23, 1981; Application No. 51-126979; Filed: Aug. 21, 1976; Applicant: Tokiwa Kogyo, Ltd.; Inventor: Chuji Noh).

This prior-art technique is such that, as FIG. 11 illustrates, a beltlike heat-shrinkable film 4 having spaced lines of perforations 7 is formed into a tubular shape in a former 5 and articles 9 are then fed into the tubulated film 4 which, in turn, is transported into a tunnel-shaped heating unit 26*e* while containing the articles 9 therein for being heated in the tunnel.

According to this technique, the film 4 is shrunk by heating so that it can be autocut along each line of perforations 7 under tension due to shrinkage. Cut film ends can be set in intimate contact with the front and rear sides 9*a*, 9*b* of each article 9 by subsequent heating.

Therefore, according to such technique, in which the film 4 is subject to no mechanical cutting, impact due to film cutting is insignificant and there falling of articles 9 is prevented. Additionally, since the film 4 is cut while being shrunk, cut film ends have greater tension to provide substantially great strength for enabling the film to cover and hold sides of the article 9. Therefore, the technique permits assembly packaging of a plurality of articles 9 . . . as illustrated in FIG. 12.

However, from the standpoint of practical application, the prior art technique involves a number of problems as pointed out below.

In order to carry out heat shrinking and cutting of the film 4 properly in shrink packaging, it is necessary that the entire surface of the film 4 surrounding the article 9 must be thoroughly and uniformly heated by the heating unit 26*e*.

However, with the prior-art technique, in which each article 9 is fed into the tunnel-like heating unit 26*e* as it is placed on a conveyor 40, the botton portion of the article 9 in contact with the conveyor belt cannot be as effectively heated as the other sides of the article 9. Moreover, the film portion at the bottom of the article 9 which is in direct contact with the conveyor belt is prevented from proper shrinking because of possible friction due to its contact with the conveyor belt. Therefore, film shrinkage at the bottom of the article 9 is lower than that at the top and other sides of the article 9, which fact has made it difficult to obtain uniform shrinkage of the film as a whole. Consequently, as FIG. 12 illustrates, a large number of creases develop around the lower periphery of the resulting package due to a difference in film shrinkage between the top and side portions of the package on one hand and the bottom portion thereof on the other, which fact renders the appearance of the package unsightly.

In the case where the film 4 is thin and flexible, it is necessary that hot air used in film heating should, as FIG. 13 shows, be uniformly blown toward film ends from the top and bottom directions as indicated by arrows A in order to allow autocut film ends 42, 42*a* to be set neatly along sides of the article 9.

However, the prior art technique involves a problem such that hot air blasting toward the lower film ends 42 is prevented by the belt 41 of the conveyor 40, so that the film ends 42*a* are shrunk as they remain held apart from the sides of the article. Therefore, as FIG. 12 shows, the lower ends 42*a* of the film sag, thus making the appearance of the package all the more unsightly.

SUMMARY OF THE INVENTION

Accordingly, it is an object of the present invention to provide a shrink packaging apparatus which can produce a very fine looking shrink-wrap package by enabling the entirety of the film surrounding the article to be uniformly heated so that the entire film surface can be brought in close and neat contact with the entire surface of the article.

The invention is directed to solving the foregoing problems with the prior art by arranging for film heating while the to-be-packaged article is kept open at its bottom and not heating the film in a condition such that the article is simply placed on the belt of the conveyor.

According to the invention, there is provided a shrink packaging apparatus comprising a double side-holding conveyor 18 provided behind a former 5 which forms a beltlike film continuously into a tubular shape, for transporting the tubulated film 4 surrounding each article 9 to be packaged while the film 4 is left open at its top and bottom sides. The conveyor 18 consists of a pair of circulation-drivable belts 20, 20 arranged in horizontally opposed relation for supporting opposite longitudinal sides of the tubulated film 4 therebetween, a carry-on conveyor 21 separately provided behind the former 5 for transporting the tubulated film 4 surrounding the article 9 while supporting the film 4, with its sides exposed, on a horizontally driven belt 23, the double side holding conveyor 18 and the carry-on conveyor 21 being interconnected so that the tubulated film 4 surrounding the article 9 is transported from the former conveyor 18 to the latter conveyor 21 so as to enable the tubulated film 4 to be continuously transported downstream of the former 5, and one or more heating units 26, 26*a* disposed at the site of each of the double side-holding and carry-on conveyors 18, 21 so that the tubulated film 4 is heated with respect to its exposed top and bottom portions at the site of the double side-holding conveyor 18 and is heated with respect to its exposed sides at the site of the carry-on conveyor 21.

According to the above arrangement, the tubulated film surrounding each article is heated at its top and bottom sides while it is transported on the double side-holding conveyor, and is heated at its laterally opposite sides. Further, the continuous tubulated film is cut along each line of perforations under tension due to shrinkage caused to the film during such heating, so that individual shrink-wrapped packages can be produced.

According to the invention, therefore, it is possible to heat the tubulated film properly over its entire surface without incurring trouble from insufficient local heating.

Hence, according to the invention, it is possible to allow the entire surface of the film to be uniformly shrunk so that the film neatly comes in intimate contact with the outer surface of each article, and thus, provides packages having an exceptionally good appearance and improved commercial value.

During the stage of heating different sides of the tubulated film, the portions of the film being subjected to heating are not covered by relevant conveyor belts in all cases and accordingly very good heating efficiency can be obtained. Moreover, when hot air is used as a heating medium, hot air can be blown directly toward cut ends of the film. It is thus possible to allow the film ends autocut at the sites of perforations to neatly fit on the sides of the article, without undue sagging, for intimate contact therewith, even if the film is of the flexible type.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
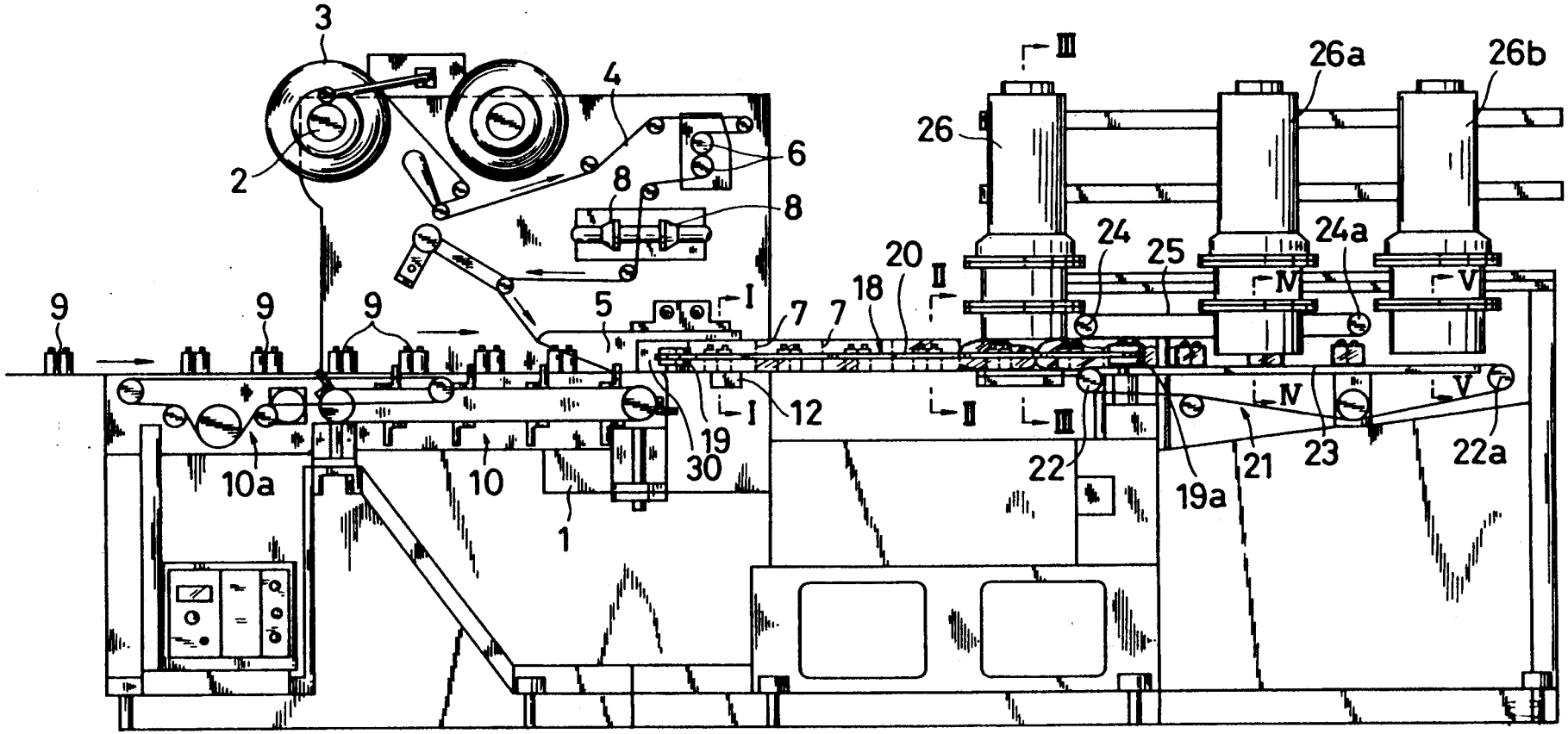
FIG. 1 is a schematic view in side elevation showing one embodiment of the packaging apparatus according to the present invention.

Referring to FIG. 1 in which a packaging apparatus of the invention is schematically shown, the packaging apparatus has a base frame 1 on which is mounted a former 5 for forming into a continuous tube a continuous beltlike film 4 drawn from a film roll 3 mounted on a film holder 2. Rotatably operable feed rollers 6 for delivering a continuous beltlike film 4 are disposed at a film feeding stage located prior to the former 5. Below the feed rollers 6, a perforator 8 is disposed for punching lines of perforations 7 serving as cutting lines in the beltlike film 4 at a predetermined pitch widthwise thereof. The perforator 8 may, for example, be one having a multiplicity of needles arranged in straight rows such that the needles are periodically advanced toward the film 4 for perforating the film 4 with a multiplicity of fine holes.

Figure 3:
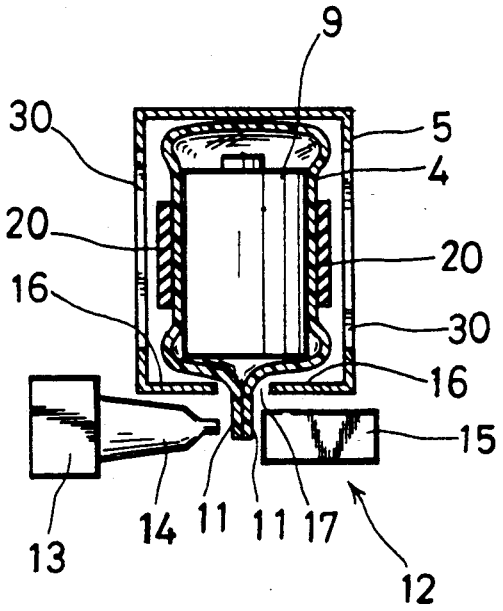
FIG. 3 is a section taken along line I—I in FIG. 1.

Two feed conveyors 10, 10*a* are arranged ahead of the former 5 for feeding articles 9 toward the former 5 so that a plurality of articles 9 are sequentially fed at predetermined intervals into the film 4 as the film is tubulated at the former 5. Disposed below a rear portion of the former 5 is a sealer 12 for sealing together opposite side edges 11, 11 of the tubulated film 4. The sealer 12 may, for example, be one having a hone 14 connected to a ultrasonic oscillator 13, and an anvil 15 disposed in opposed relation to the hone 14, as illustrated in FIG. 3, which seals under the action of ultrasonic waves the opposite side edges 11, 11 of the film 4 as the side edges 11, 11 are conducted downwardly through a clearance 17 between bottom plates 16, 16 of the former 5.

Figure 2:
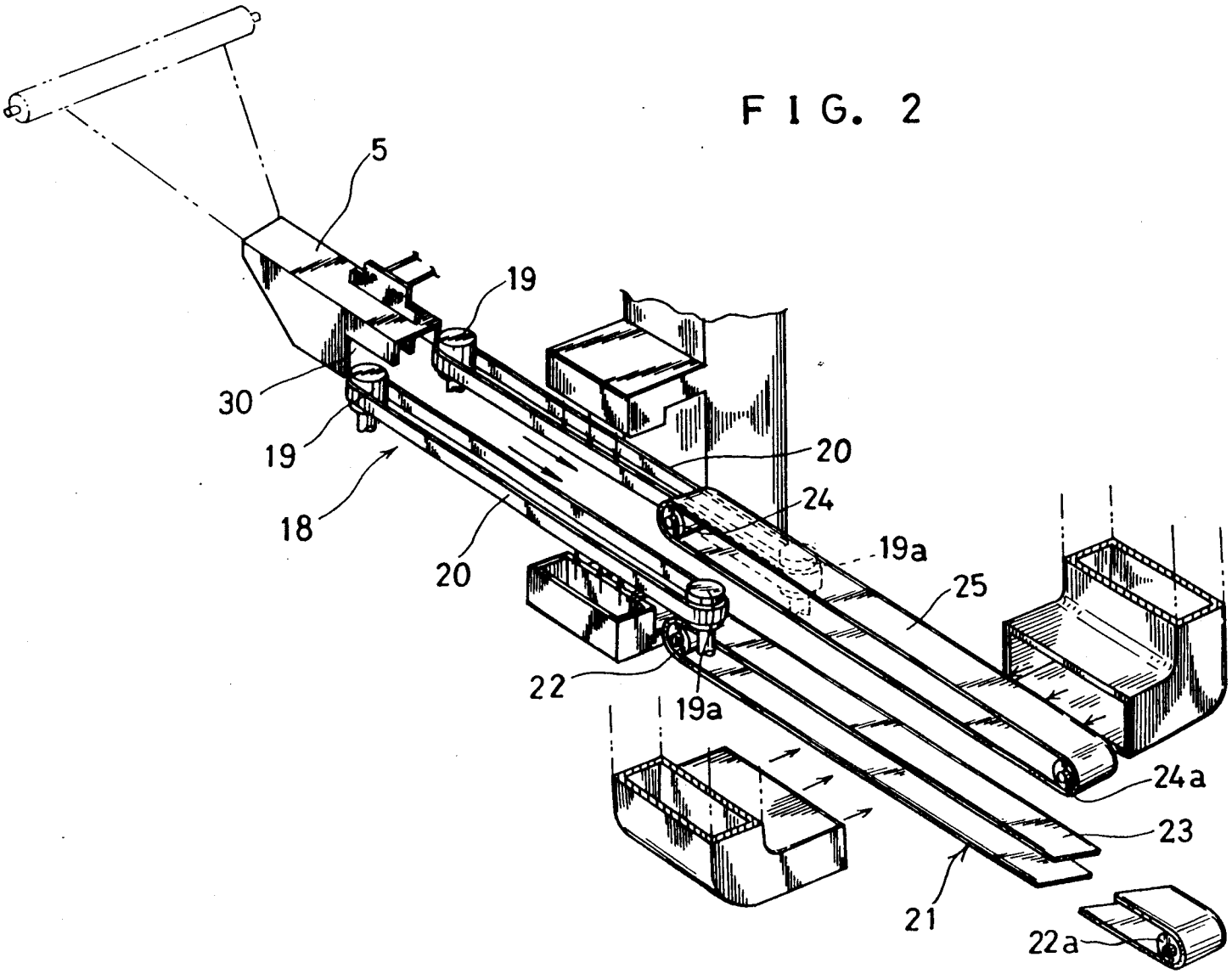
FIG. 2 is a partial view in perspective showing the arrangement of conveyors provided at stages subsequent to the former.

There is provided, as FIG. 1 shows, a double side-holding conveyor 18 extending rearwardly from a rear end portion of the former 5. Each twin half of the conveyor 18 comprises a pulley 19 disposed beside a recessed side portion 30 of the former 5, a motor driven pulley 19*a* spaced apart rearwardly from the pulley 19, and a belt 20 trained between the pulleys 19, 19*a*. The two pulleys 19, 19*a* are vertically supported and the belt 20 is circulatably driven to run in a horizontal direction. Two such belts 20, 20 are provided in parallel to form a pair so that, as FIG. 2 shows, they contact opposite sides of the tubulated film 4 from the former 5 so as to transport the film 4 downstream while holding it between them. The two belts 20, 20 are driven to run at the same speed and in the same direction.

A carry-on conveyor 21 extends straight rearwardly from a rear end portion of the double side-holding conveyor 18. The conveyor 21 comprises a plurality of horizontally supported pulleys 22, 22*a* and a belt 23 circulation-drivably trained between the pulleys 22 and 22*a* for carrying and supporting packages thereon. The front pulleys 22 are disposed at the forward side of the rear pulleys 19*a* of the double side-holding conveyor 18 so that the upstream side of the belt 23 is located under the downstream side of the side-holding conveyor 18 in overlapping relation thereto. Accordingly, each package transported on the double side-holding conveyor 18 is then smoothly delivered onto the carry-on conveyor 21.

A separate driving belt 25 trained between pulleys 24, 24*a* runs above the circulation driving belt 23 in face-to-face relation thereto. The upper belt 25 is smaller in length than the lower belt 23, with a space left open above a rear end portion of the belt 23 of the carry-on conveyor 21.

In the present embodiment, there are provided heating units 26, 26*a*, 26*b* which are arranged in three locations. Each of the heating units 26, 26*a*, 26*b* comprises a heater and a fan and is designed to blast hot air of a temperature sufficient to shrink the shrinkable film 4.

Figure 5:
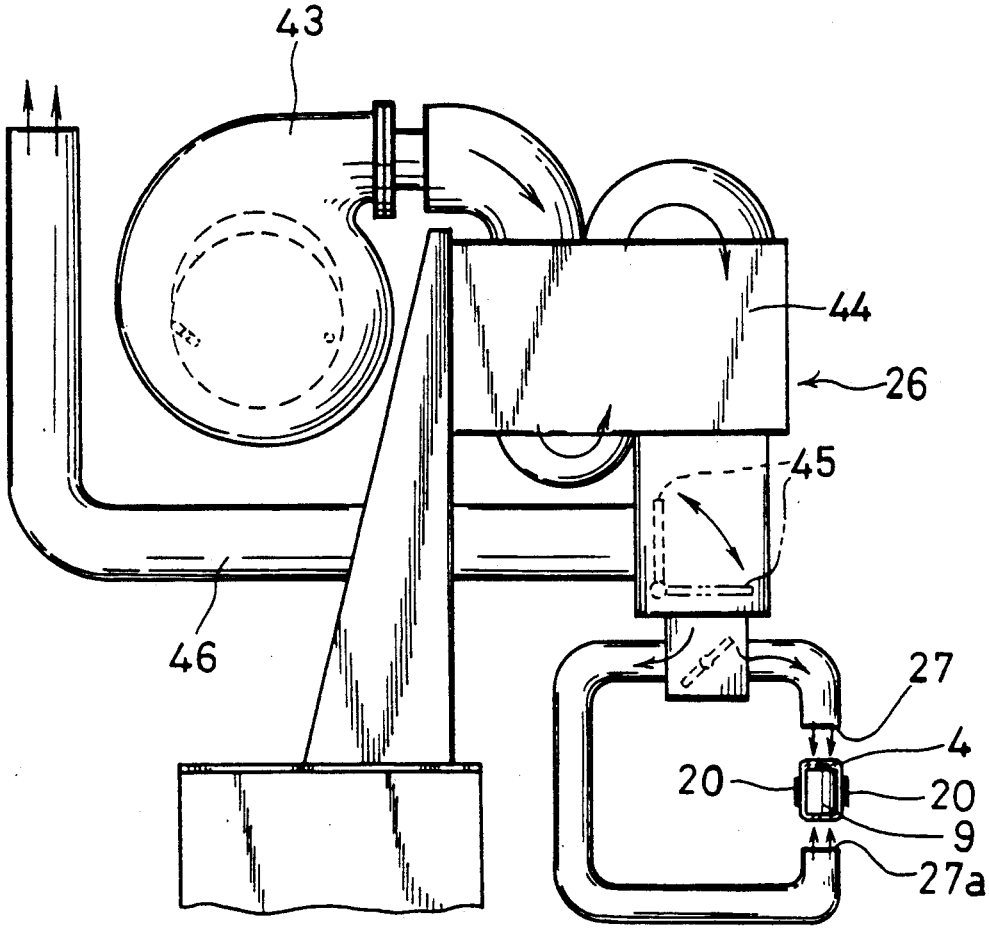
FIG. 5 is a section taken along line III—III in FIG. 1.

The heating unit 26 is disposed adjacent a rear portion of the double side-holding conveyor 18, being of such arrangement that, as FIG. 5 shows, air sucked by means of a fan 43 is passed through a heater 44 for being heated so that hot air is continuously blown through air blow ports 27, 27*a* via a damper 45. When heating is not required, the damper 45 operates to let air escape toward an exhaust duct 46. The upper and lower air ports 27, 27*a* are disposed in vertically opposed relation across a space between the belts 20, 20.

Figure 6:
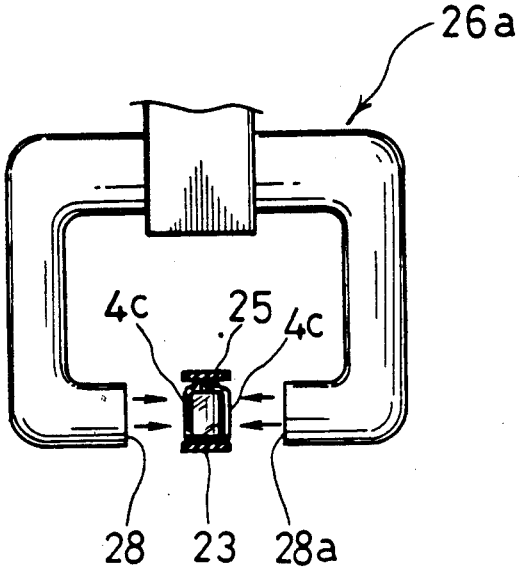
FIG. 6 is a section taken along line IV—IV in FIG. 1.
Figure 7:
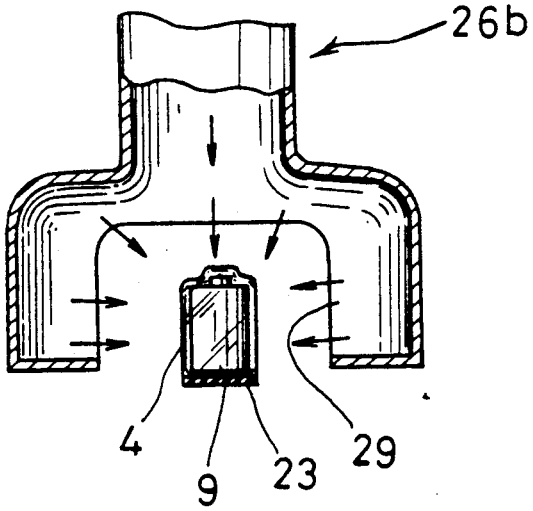
FIG. 7 is a section taken along line V—V in FIG. 1.

Another heating unit 26*a* is disposed at a site where the upper and lower belts 23, 25 of the carry-on conveyor 21 are positioned in vertically opposed relation and, as FIG. 6 shows, two hot-air ports 28, 28*a*, right and left, are disposed in horizontally opposed relation across a space between the belts 23, 25. Another heating unit 26*b*, which is not necessarily required in the present invention, is disposed above the rearmost site of the carry-on conveyor 21 and, as FIG. 7 shows, it has a hot-air port 29 which is so large-sized as to allow hot air to be blown over substantially the whole surface of each package.

Having described the arrangement of one embodiment of the invention, the manner of operation of the apparatus representing the embodiment will now be described with respect to an exemplary case in which the apparatus is employed, for example, in packaging dry cells 9.

A continuous beltlike heat-shrinkable film 4 is first drawn out by feed rollers 6 from the film roll 3 and fed to the former 5. In the course of this film feeding, lines of perforations 7 are sequentially formed by the perforator 8 on the film 4 widthwise thereof at the predetermined pitch.

As the film 4 is fed to the former 5, the film 4 is continuously tubulated and, in this conjunction, dry cells 9 transported on the feed conveyor 10 are sequentially fed, for example, in sets of two into the tubulated film 4 at the predetermined pitch. In this case, each set of dry cells 9 are placed between adjacent lines of perforations 7, 7 on the film, for which purpose the feed conveyor 10 should be previously adjusted with respect to its feed timing. Segments of the tubulated film 4 in which sets of dry cells 9 are individually housed are, as FIG. 3 shows, successively sealed by the sealer 12 at their opposite side edges 11, 11 in the longitudinal direction of the flow of the film 4 so that they are accurately kept in good tubular configuration.

Figure 4:
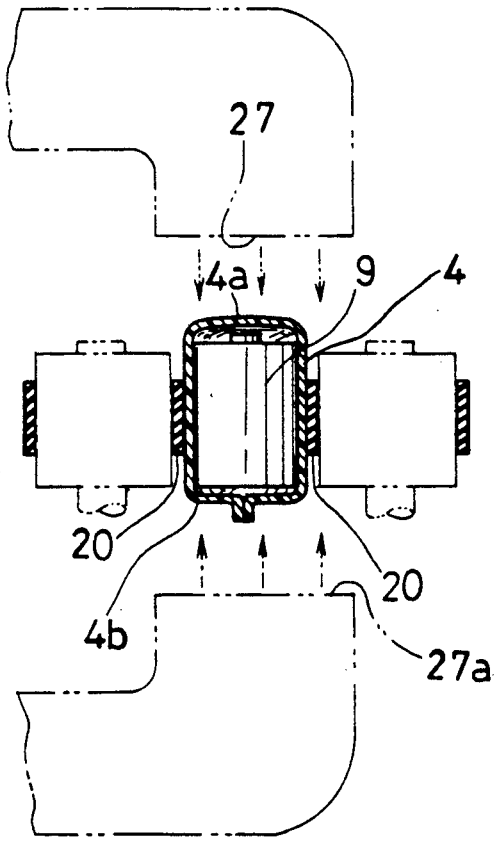
FIG. 4 is a section taken along line II—II in FIG. 1.

Subsequently, the tubulated film 4 in which sets of dry cells 9 are housed is transferred at the rear end of the former 5 onto the double side-holding conveyor 18 and transported downstream while being held between the two belts 20, 20 of the conveyor 18. In this course of transport, as FIG. 4 shows, the tubulated film 4, with sets of dry cells 9 housed therein, passes through the space between the hot air blow ports 27, 27*a* of the heating unit 26 as it is lifted by being securely held between the belts 20, 20. Top and bottom portions 4*a*, 4*b* of the tubulated film 4 remain open and uncovered with belts, and accordingly the portions 4*a*, 4*b* of the film can be efficiently heated. The side portions of the film 4 at which the film is held between the belts 20, 20 are prevented from being heated and, therefore, the top and bottom portions of the tubulated film 4 are locally shrunk.

With such local film shrinkage only, no complete separation occurs along each line of perforations 7, but only local separation occurs at top and bottom sides of the film 4. Since hot air is blown from the vertically opposed air blow ports 27, 27*a* toward the film 4, top and bottom side film portions projecting outwardly of each set of dry cells are guided by blowing air so as to extend along sides of the set of dry sells 9. Therefore, the bottom side ends of the film 4 will never tend to shrink while showing an unsightly sagging behavior.

Figure 8A:
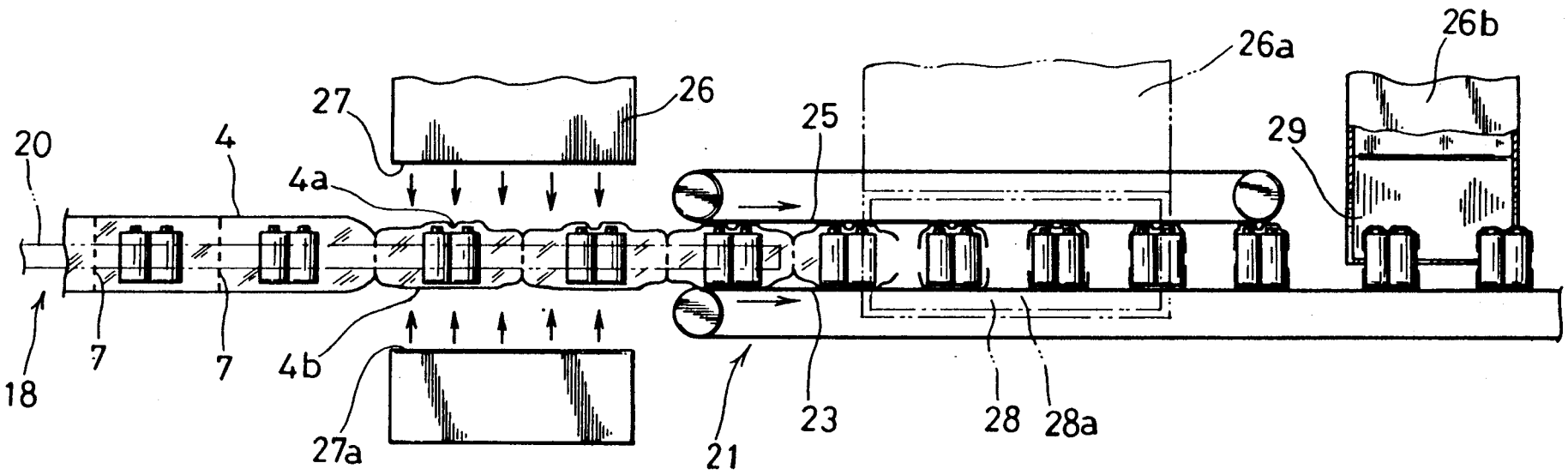
FIG. 8*a* is a sectional view showing the stage of film transfer and heat shrinking.
Figure 8B:
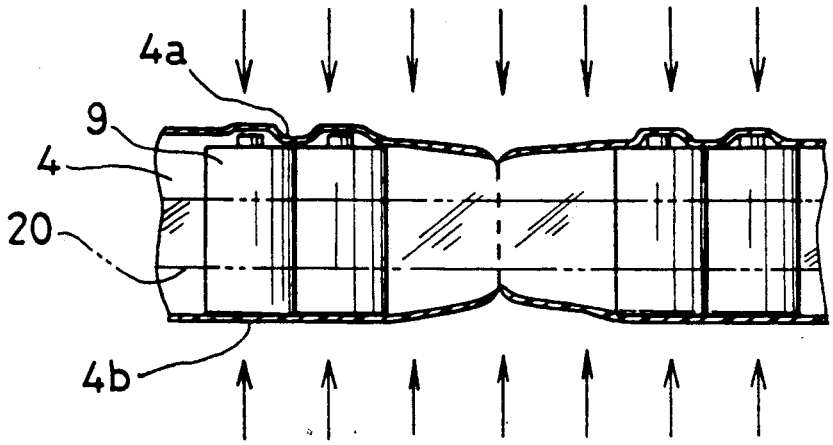
FIGS. 8*b* and 8*c* are partially enlarged sectional views of the stage shown in FIG. 8*a;*
Figure 8C:
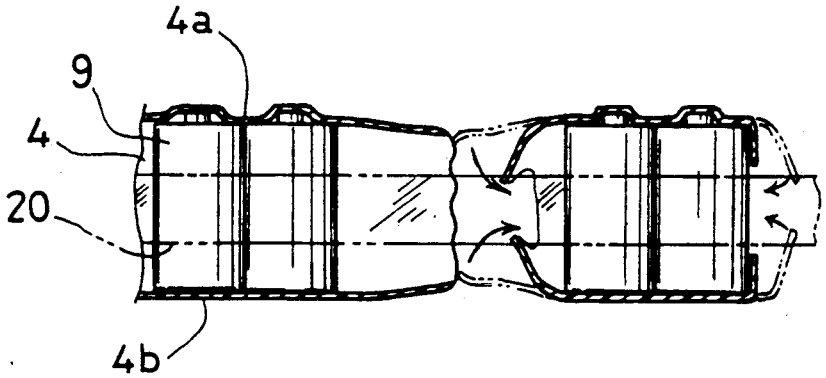

Then, the tubulated film 4 is transferred from the double side-holding conveyor 18 onto the carry-on conveyor 21. While being carried on the conveyor 21, the tubulated film 4 is transported downstream as it is vertically held between the upper and lower belts 23, 25, with its top and bottom ends respectively held in contact therewith. At this stage, opposite side portions 4*c*, 4*c* of the tubulated film 4 which have not been heated during the previous heating stage are exposed as shown in FIG. 6 so that the side portions 4*c*, 4*c* are efficiently heated by hot air blown from the air ports 28, 28*a* of the heating unit 26*a*. Consequently, as FIG. 8 shows, the film 4 is autocut along lines of perforations under increased shrinkage tension due to heating. Since each set of dry cells 9 is in contact at its top and bottom ends respectively with the belts 23, 25 of the carry-on conveyor 21, there is no possible occurrence of such trouble as falling due to any shock caused during the film cutting. The cut side portions of the film 4 are heat-shrunk by hot air blowing so as to be allowed to extend neatly along the sides of each set of dry cells 9.

Figure 9:
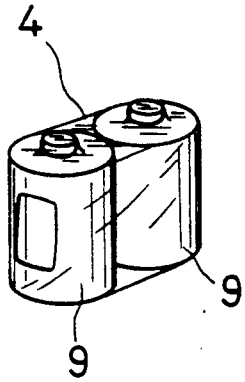
FIG. 9 is a perspective view showing by way of example a package produced.

During the above two stages of heating operation, hot air can be efficiently blown over all the top and bottom and side surfaces of the tubulated film 4 and thus packages having excellent appearance effect can be obtained such that all portions of each package are uniformly sheat-shrunk as shown in FIG. 9. The film 4 is autocut under a film tension caused by heat shrinking and, therefore, separated film ends come in taut and close contact with sides of each set of dry cells 9, the film 4 being thus able to provide high-strength wrapping effect with respect to each set of dry cells 9. Therefore, even when dry cells 9 are packaged in sets of two each, there will be no possibility of packages easily getting out of shape.

Packages individually separated in manner as described above are then transported to the rear portion of the carry-on conveyor 21 where they are heated by the heating unit 26*b*. At this site the film surface is heated all over, whereby the film 4 is treated to the desired finish condition with respect to its shrinkage and degree of contact with the dry cell surface.

In this invention, however, the heating unit 26*b* for overall finishing in particular is not necessarily required. Nor is it always necessary to provide separate heating units, one at a location adjacent the double side-holding conveyor 18 and another at a location adjacent the carry-on conveyor 21. For example, a single heating unit may be provided by locating it astride the border between the two conveyors 18, 21.

Each heating unit employed in the invention is not necessarily limited to one of the hot-air blowing type, but alternatively it may be, for example, of such arrangement that a heater is disposed in opposed relation to the tubulated film 4 for electrically heating the film.

Figure 10:
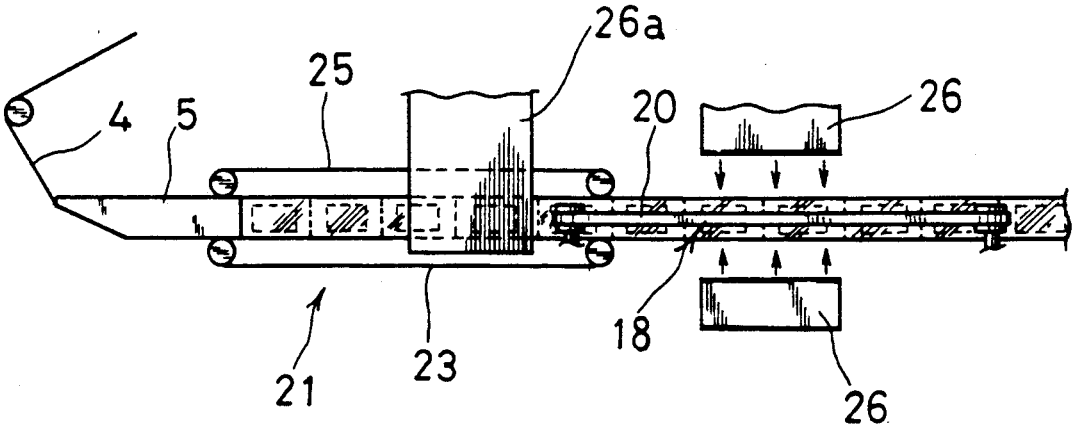
FIG. 10 is a fragmentary side view showing another embodiment of the invention.
Figure 11:
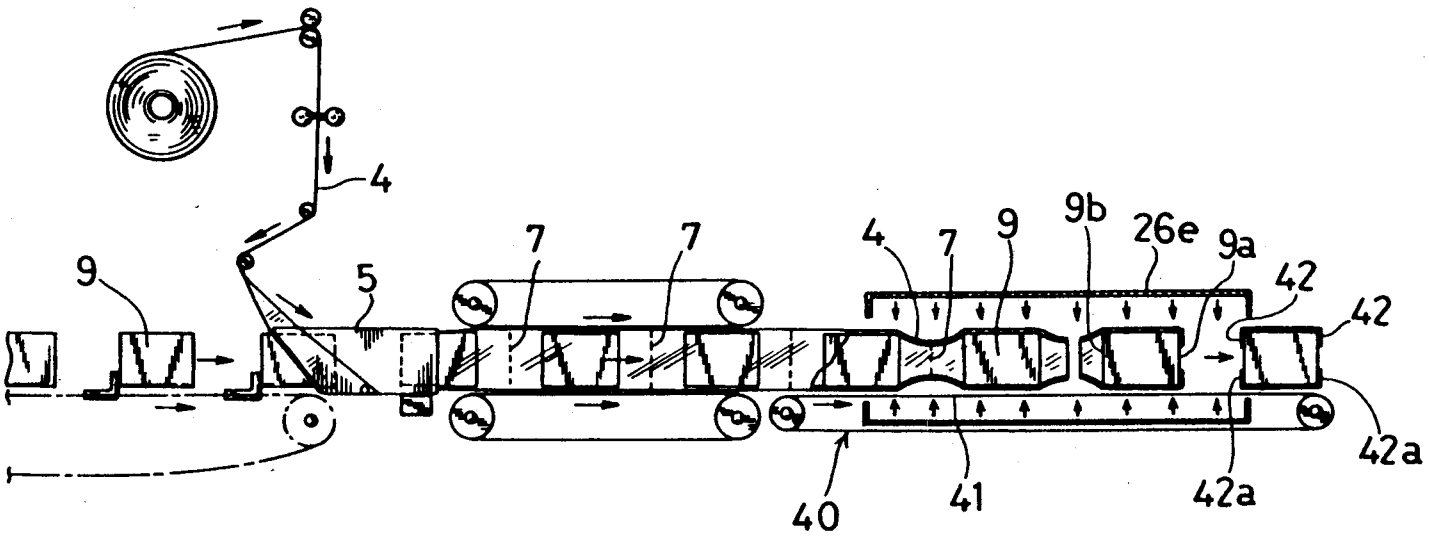
FIG. 11 (Prior Art)
FIG. 11 is a side view partly in section showing a prior-art packaging apparatus.
Figure 13:
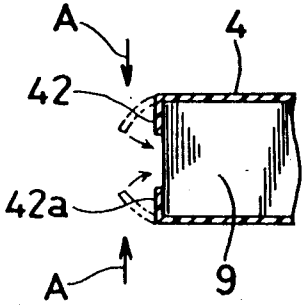
FIG. 13 (Prior Art)
FIG. 13 is a fragmentary sectional view showing by way of example a prior art film heat-shrinking operation.
Figure 12:
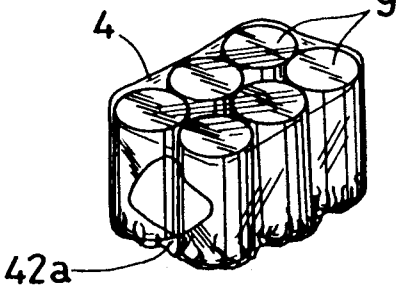
FIG. 12 (Prior Art)
FIG. 12 is a perspective view showing by way of example a package produced in prior art packaging operation.

In the above described embodiment, the carry-on conveyor 21 is provided downstream of the double side-holding conveyor 18, but it must be understood that the invention is not limited by such arrangement. As FIG. 10 illustrates, for example, the carry-on conveyor 21 equipped with upper and lower driving belts 23, 25 is provided after the former 5, and in succession to the conveyor 21 may be provided the double side-holding conveyor 18 comprising two belts 20.

In the invention, details as to the construction and arrangement of the various conveyors are not limited to those described with respect to the foregoing embodiment, nor are details as to the former and other devices limited thereto. There is no limitation whatever as to the material and type of the conveyor belts. All details of various parts may be varied, modified, or altered in design as desired within the claimed scope of the invention.

In the invention, no particular limitation is placed on the material of film 4. It is possible to use a film roll previously stamped with perforations by settin it in the packaging machine, instead of employing a perforator 8.

Further, it is understood that the type or kind of the article to be packaged is in no way limited to dry cells.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for shrink packaging articles comprising the steps of:

feeding articles through a former;

forming a continuous belt-like heat-shrinkable film into a tubular shape in the former;

enclosing the articles in the tubular film as the articles move through the former;

solely supporting sides of the articles after the articles have moved from the former so that the film covered tops and bottoms of the articles being unsupported and entirely exposed while the sides of the articles are solely supported;

heating film at tops and bottoms of the articles while the articles are solely supported at their sides;

conveying the articles while supporting at least the bottoms thereof after the articles have moved from the former, film at the sides of the articles being exposed during the step of conveying;

heating film at the sides of the articles during the step of conveying; and heat-shrinking the film during the steps of heating and cutting the film in response to the heat-shrinking to thereby form individual packages of articles.

2. The method as recited in claim 1, wherein the step of solely supporting is carried out before the step of conveying and the step of solely supporting further comprises the step of transporting the articles from the former to a carry-on conveyor for the conveying of articles.

3. The method as recited in claim 1, wherein the step of conveying articles comprises a first step of covering the tops and bottoms of the articles over some of a selected distance the articles are conveyed and a second step of covering only the bottoms of the articles over a remainder of the selected distance, and wherein the step of heating film at the sides of the articles takes place when the tops and bottoms of the articles are covered and the method further comprising the step of heating film at the tops and sides of the articles when the bottoms of the articles are only covered during the second step of covering.

4. The method as recited in claim 1, wherein the step of heating film at the tops and bottoms of the articles comprise blasting hot air from ports disposed in opposed relation above and below a transport path for the articles, and the step of heating film at the sides of the articles comprise blasting hot air from ports disposed in opposed relation at both sides of the transport path for the articles.

5. The method as related in claim 1, further comprising the step of perforating the film to form cutting lines along which the film is cut, the step of perforating occurring before the step of forming the film into a tubular shape.

6. The method as recited in claim 1, wherein the step of solely supporting further comprises the step of transporting the articles in single file whereby both sides of the articles are simultaneously supported.

7. The method as recited in claim 1, wherein the step of heating film at tops and bottoms of the articles occurs before the step of heating film at the sides of the articles.

8. A shrink packaging apparatus comprising:

a former for forming a continuous belt-like heat-shrinkable film into a tubular shape, the film having cutting lines;

a feed conveyor for feeding a plurality of articles to the former and into the film which is formed into the tubular shape such that said film surrounds the articles;

a double side-holding conveyor provided downstream of the former for holding only sides of the articles and the film at the sides of the articles, said double side-holding conveyor transporting the articles over a predetermined distance and being the sole support for the articles over at least a portion of the predetermined distance so that the film covered tops and bottoms of the articles being unsupported and entirely exposed as said articles move over the portion of the predetermined distance;

a carry-on conveyor provided downstream of the former for conveying the articles over a selected distance, the double side-holding conveyor and the carry-on conveyor being interconnected whereby articles move from one of the double side-holding conveyor and the carry-on conveyor to the other of the conveyors, the carry-on conveyor supporting at least the bottoms of the articles, film at the sides of the articles being exposed as the articles move over at least a portion of the selected distance; and heating units provided downstream of the former, the heating units cooperating with the double side-holding conveyor and the carry-on conveyor to heat-shrink the film surrounding the articles and to cut the film along the cutting lines due to heat shrinkage, film at the tops and bottoms of articles being heat shrunk when the articles are on the double side-holding conveyor and film at least at the sides of the articles being heat shrunk when the articles are on the carry-on conveyor whereby the film comes into close contact with an outer surface of the articles and individual packages of articles are formed.

9. The shrink packaging apparatus as recited in claim 8, wherein the double side-holding conveyor comprises a pair of continuous belts disposed in horizontally opposed relation, the belts supporting opposite longitudinal sides of the film therebetween.

10. The shrink packaging apparatus as recited in claim 8, wherein the carry-on conveyor comprises a horizontally driven belt.

11. The shrink packaging apparatus as recited in claim 8, wherein the carry-on conveyor comprises a pair of vertically spaced belts, the articles being conveyed between the spaced belts, an upper belt of the pair being shorter than a lower belt of the pair whereby film at the tops of the articles is exposed over some of the selected distance the articles are conveyed by the carry-on conveyor and wherein the heating unit further heats the film at the tops of the articles when the tops are exposed on the carry-on conveyor.

12. The shrink packaging apparatus as recited in claim 11, wherein the heating units comprise at least three units with one unit being positioned adjacent the double side-holding conveyor, one unit being positioned adjacent the carry-on conveyor along a section having the pair of vertically spaced belts, and one unit being positioned adjacent the carry-on conveyor along a section having the lower belt with film at the tops of the articles being exposed.

13. The shrink packaging apparatus as recited in claim 8, wherein the heating units comprise a plurality of units with at least one unit positioned adjacent the double side-holding conveyor and at least one unit positioned adjacent the carry-on conveyor.

14. The shrink packaging apparatus as recited in claim 8, wherein the double side-holding conveyor and the carry-on conveyor are each provided with two heating units, one pair of heating units at the double side-holding conveyor having hot air blasting ports disposed in opposed relation at upper and lower portions on a transport path for the articles, the other pair of heating units at the carry-on conveyor having hot air blasting ports disposed in opposed relation to both sides of the transport path for the articles.

15. The shrink packaging apparatus as recited in claim 8, wherein each of the heating units is an electric heater for heating the film.

16. The shrink packaging apparatus as recited in claim 8, wherein said carry-on conveyor is provided downstream of the double side-holding conveyor, an upstream side of the carry-on conveyor is disposed in overlapping relation to a downstream side of the double side-holding conveyor whereby the articles and surrounding film transported by the double side-holding conveyor are directly transferred to the carry-on conveyor.

17. The shrink packaging apparatus as recited in claim 8, further comprising a perforator for providing the cutting lines to the film which is subsequently formed by the former, the cutting lines provided by the perforator being lines of perforations at predetermined pitch in the film.

18. The shrink packaging apparatus as recited in claim 8, wherein the articles transported by the double side-holding conveyor are in single file whereby the double side-holding conveyor supports both sides of each article.

19. The shrink packaging apparatus as recited in claim 8, wherein the individual packages of articles contain one of a single article, a pair of articles and a plurality of articles and wherein the heating units heat ends of the individual packages to prevent sagging of the film forming the packages.

20. The shrink packaging apparatus as recited in claim 8, wherein the heating units first heat the film at the tops and bottoms of the articles and thereafter heat the film at the sides of articles.

* * * * *